United States Patent [19]

Bon et al.

[11] Patent Number: 4,778,576

[45] Date of Patent: Oct. 18, 1988

[54] NICKEL ALLOY ANODES FOR ELECTROCHEMICAL DECHLORINATION

[75] Inventors: Charles K. Bon, Concord; Kevin S. Meldrum, San Francisco; Donald N. Brattesani, Oakland, all of Calif.

[73] Assignee: The Dow Chemical Company, Midland, Mich.

[21] Appl. No.: 891,814

[22] Filed: Jul. 31, 1986

[51] Int. Cl.[4] ..... C25B 3/00; C25B 11/04

[52] U.S. Cl. ..... 204/72; 204/73 R; 204/293

[58] Field of Search ..... 204/293, 73 R, 72, 73 A, 204/76, 292, 291

[56] References Cited

U.S. PATENT DOCUMENTS

| | | | |
|---|---|---|---|
| 2,304,059 | 12/1942 | Bieber et al. | 204/293 |
| 2,755,241 | 7/1956 | Bagley et al. | 204/293 X |
| 4,217,185 | 8/1980 | Kyriacou et al. | 204/73 R |
| 4,304,647 | 12/1981 | Lutz et al. | 204/293 X |
| 4,374,721 | 2/1983 | Hara et al. | 204/292 X |
| 4,497,697 | 2/1985 | Marshall et al. | 204/73 R |

OTHER PUBLICATIONS

"The Cost of Electrochemical Cells", *AIChe Symposium* 185, *Electroorganic Synthesis Technology*, pp. 76–88, vol. 75 (1979).

*Primary Examiner*—John F. Niebling
*Assistant Examiner*—John S. Starsiak, Jr.
*Attorney, Agent, or Firm*—D. Wendell Osborne

[57] ABSTRACT

Nickel alloy anodes are suitable for electrochemical cells that are used for the selective replacement of chlorine in organochlorine compounds with hydrogen and are resistant to corrosion. Electrochemical cells containing Hastalloy C-276 anodes and silver cathodes, for example, are used to convert tetrachloropicolinic acid to 3,6-dichloropicolinic acid.

18 Claims, No Drawings

NICKEL ALLOY ANODES FOR ELECTROCHEMICAL DECHLORINATION

BACKGROUND OF THE INVENTION

The replacement of chlorine in organochlorine compounds with hydrogen by means of electrochemical reduction is a known and valuable process. 2,3,5,6-Tetrachloropyridine and 2,3,5-trichloropyridine, which are important intermediates for the production of insecticides, herbicides and the like, for example, are known to be prepared by the electrochemical reduction of pentachloropyridine (U.S. Pat. No. 3,694,332) and 2,3,5,6-tetrachloropyridine (U.S. Pat. No. 4,242,183), respectively. In a similar manner, 3,6-dichloropicolinic acid is known to be prepared from tetrachloropicolinic acid or 3,5,6-trichloropicolinic acid (U.S. Pat. No. 4,217,185).

The development of commercial processes based on electrochemistry is highly dependent upon the development of electrochemical cells that are efficient with respect to electrical energy utilization, can be constructed for a reasonable price, have a long service life and which selectively facilitate the desired reaction. Cells that are useful for the replacement of chlorine in organochlorine compounds with hydrogen involve at the minimum: a cathode at which the electrochemical dechlorination takes place, an anode at which water is converted to oxygen, and an electrolyte which initially contains the organochlorine compound to be reduced.

The electrochemical cells which have been reported to-date for use in processes in which chlorine in organochlorine compounds is replaced with hydrogen have proven to be unsatisfactory with respect to the anodes employed. The graphite anodes disclosed in U.S. Pat. No. 4,217,185 were found to be very sensitive to the type of graphite involved and suffered from a tendency to spall and to lose activity and selectivity in use. They further tend to contain traces of heavy metal impurities which leach into the electrolyte and inactivate the cathode. Electrochemical cells using graphite anodes were, accordingly, found to have a short service life. The stainless steel anodes disclosed in U.S. Pat. No. 4,533,454 were found to corrode at an unacceptably high rate. This corrosion not only damages the anode, but also releases heavy metal ions into the electrolyte which inactivate the cathode. As a consequence, cells containing stainless steel anodes also have relatively short service lives.

The discovery of new anodes for the electrochemical replacement of chlorine in organochlorine compounds by hydrogen cells is, therefore, of great interest. Suitable anodes should be (1) resistant to spalling and dimensionally stable, (2) resistant to corrosion (a) in aqueous alkaline media containing chloride ion; (b) in concentrated hydrochloric acid, and (c) when cycled between cathodic and anodic potentials, (3) inert with respect to contaminating the electrolyte and cathode with heavy metal ions, (4) active in producing oxygen from aqueous solutions containing chloride ion, and (5) able to cooperates with a suitable cathode to selectively replace chlorine in organochlorine compounds with hydrogen.

SUMMARY OF THE INVENTION

It has now been found that anodes constructed of certain nickel alloys meeet all of the criteria required for anodes to be used in electrochemical cells employed for the replacement of chlorine in organochlorine compounds with hydrogen. Accordingly, the present invention relates to those anodes and to electrolytic cells useful in the selective replacement of chlorine in organochlorine compounds with hydrogen, which cells comprise an anode having as its surface an alloy comprising essentially about 40 to about 70 percent nickel, about 5 to about 30 percent chromium, and about 3 to about 25 percent molybdenum.

Electrochemical cells comprising nickel alloy anodes as defined hereinabove overcome the corrosion, contamination and spalling problems associated with previously known cells which have caused these cells to have short service lives.

In an especially preferred embodiment, the cell comprises a silver electrode as defined in U.S. Pat. Nos. 4,242,183 and 4,460,441, a nickel alloy anode comprising approximately 55 percent nickel, 16 percent chromium, 16 percent molybdenum, 5 percent iron, 4 percent tungsten, and 1 percent manganese, and an alkaline aqueous electrolyte.

The cells of the invention are especially useful in preparing 3,6-dichloropicolinic acid from tetrachloropicolinic acid or 3,5,6-trichloropicolinic acid and the invention includes the process of preparing 3,6-dichloropicolinic acid utilizing an electrochemical cell which comprises a nickel alloy anode as defined hereinabove. Thus, it relates to an improved process for preparing 3,6-dichloropicolinic acid by the reductive dechlorination of tetrachloropicolinic acid or 3,5,6-trichloropicolinic acid in an electrochemical cell, which improvement comprises using an electrochemical cell comprised of an anode having as its surface an alloy comprising essentially about 40 to about 70 percent nickel, about 5 to about 30 percent chromium, and about 3 to about 25 percent molybdenum.

DETAILED DESCRIPTION OF THE INVENTION

Electrolytic cells utilizing nickel alloy anodes have been found to be uniquely suited for use in the replacement of chlorine in organochlorine compounds with hydrogen. A particular group of nickel alloy anodes; that is, anodes having a nickel alloy surface, which alloy comprises about 40 to about 70 percent nickel, about 5 to about 30 percent chromium, and about 3 to about 25 percent molybdenum, is suitable. Such anodes are resistant to spalling and dimensionally stable; are resistant to corrosion in aqueous alkaline media containing chloride ion, in concentrated hydrochloric acid, and when cycled between having cathodic and anodic potentials; are inert with respect to contaminating the electrolyte and cathode with heavy metal ions; are active in producing oxygen from aqueous solutions containing chloride ion, and cooperate with suitable cathodes to selectively replace chlorine in organochlorine compounds with hydrogen. Typical nickel alloys include Hastalloy C-276 (Trademark of Cabot Corp.), Inconel 718 and Nimonic 115 (Trademarks of INCO Companies), Udimet 200, 500 and 700 (Trademarks of Special Metals Corporation), René 41 (Trademark of Teledyne Corp.) and Waspaloy (Trademark of United Technologies Corp.). Anodes having a surface composed of a nickel alloy which comprises about 50 to about 65 percent nickel, about 12 to about 20 percent chromium, and about 4 to about 20 percent molybdenum are preferred. Hastalloy C-276, which contains approximately 55 percent nickel, 16 percent chromium, 16 percent molybdenum, 5 percent iron, 4 percent tungsten, 2.5 percent cobalt, and 1 percent manganese, is especially preferred.

The cathodes of the electrolytic cells of the present invention can be any cathode that is compatable with the media involved and which, when used with a nickel alloy anode of the present invention, is capable of electrolytically replacing chlorine in organochlorine compounds with hydrogen. Silver cathodes, which are described in U.S. Pat. No. 4,242,183, are preferred and the expanded metal silver cathodes described in U.S. Pat. No. 4,460,441 are especially preferred. In both of these cathodes, the surface of the silver has a layer of microcrystals formed by electrolytic reduction of colloidal, hydrous silver oxide particles in the presence of aqueous base.

In use, the cells of the present invention contain an aqueous alkaline electrolyte. The solution is made basic by the addition of a compatable compound that produces hydroxide ion in solution, such an alkali metal, alkaline earth metal, or tetraalkylammonium hydroxide. Since chloride ion is produced as a by-product in the reductive dechlorination reaction, chloride ion is generally present. Additional chloride salts, such as sodium, potassium or tetraalkylammonium chloride are often added. Other compatable water soluble salts can be added as well. Further, compatable water soluble organic solvents can be employed as co-solvents with water. Ionic organochlorine compound substrates for electrochemical reduction and their reduction products can also serve as components of the electrolyte. Nonionic organochlorine compounds are dissolved or suspended in the electrolyte when employed as substrates for reductive dechlorination. In the foregoing, the term compatable is used to described materials that are not oxidized or reduced in the cell and do not react with or adversely affect any component of the cell.

The electrochemical cells and component cathodes and anodes of the present invention can be of any of the geometries, configurations and dimensions known to those in the art. Cells containing multiple cathodes and multiple anodes are generally preferred as are geometries and configurations suitable for continuous operation.

The organochlorine compounds which serve as substrates for the cells of the present invention can be defined as chlorine containing aliphatic, aromatic and heteroaromatic organic compounds susceptible to having chlorine replaced by hydrogen in electrolytic cells. Trichloroacetic acid, benzotrichloride, cyclohexyl chloride, 1,2,4,5-tetrachlorobenzene, o-chlorobiphenyl, 2-chloro-6-(trichloromethyl)pyridine, and tetrachloropyrazine are typical. Chlorine containing heteroaromatic compounds are preferred and chlorine containing pyridine compounds, such as pentachloropyridine, 2,3,5,6-tetrachloropyridine, tetrachloropicolinic acid and 3,5,6-trichloropicolinic acid are especially preferred. Furthermore, polychloro organic compounds, the various chlorine atoms of which can be selectively replaced by hydrogen in electrolytic cells are especially preferred substrates. Utility in the selective replacement of the 4- and 5-position chlorine atoms of tetrachloropicolinic acid and of the 5-position chlorine atom of 3,5,6-trichloropicolinic acid is of particular interest.

The process of preparing 3,6-dichloropicolinic acid by the electrolytic reductive dechlorination of tetrachloropicolinic acid or 3,5,6-trichloropicolinic acid, which process is described in U.S. Pat. Nos. 4,217,185 and 4,592,811, is improved by the use of electrolytic cells containing the nickel alloy anodes of the present invention. The descriptions of the process contained in these patents are hereby incorporated by reference. In carrying out the process of the present invention the teachings of the reference patents are followed with the exception that the nickel alloy anodes described hereinabove are employed in place of previously known anodes.

The improvement in the process lies particularly in the increased service life of the cells and the resultant increased production obtained from the cells, improved consistency of the product and reduced cost of production. This improvement is realized because the nickel alloy anodes are not only suitable for the process as noted hereinabove, but are more resistant to corrosion under the conditions of the process than previously known anodes. Consequently, they last longer themselves and do not contaminate the electrolyte and cathode with heavy metals, which results in the cathode lasting longer as well.

The use of electrolytic cells employing the silver cathodes of U.S. Pat. Nos. 4,242,183 and 4,460,441 in conjunction with the nickel alloy anodes of the present invention in the process is preferred.

The following examples are presented to illustrate the invention and should not be construed as limiting the claims.

EXAMPLE 1

To a 200 ml electrolytic beaker equipped with a Teflon-coated magnetic stirring bar, a cylindrical silver screen cathode, a cylindrical, imperforate Hastalloy C-276 anode, a Luggin capillary tube fitted with a standard calomel electrode (SCE) and a thermometer, was added enough approximately 18 percent aqueous hydrochloric acid to fill the cell (Luggin capillary removed). The acid was stirred in the cell for 10 min., drained and rinsed with reverse osmosis purified (RO) water, then filled with 108 g of 7.0 wt. percent sodium hydroxide (mercury grade caustic; solution prepared with RO water). The cathode was anodized to 0.7 V vs SCE for 7 min. (6.8 amps maximum), followed by cathodization to −1.3 V vs SCE (6.0 amps maximum), giving a background current of 0.5 ampere. Tetrachloropicolinic acid (11.76 g. 0.0451 mole) was added portionwise over 1.5 hours by masticating 3 g portions with cell liquor and then returning the resulting slurry to the bulk of the solution.

The cathode potential was held at −1.3 volts throughout the electrolysis while the cell current varied between 0.5 and 4.7 amperes. After 9.0 g of tetrachloropicolinic acid had been added, the cathode was reactivated by anodization using the same procedure as above before adding the last 2.7 g. The actual reaction time required was about 2.3 hours.

A 50.0 g aliquot of the 190.3 g of final cell liquor was diluted with 100 ml of water and acidified to pH 0.94 with hydrochloric acid. The resulting mixture was extracted 7 times with 50 ml portions of methylene chloride. The extracts were combined, dried over sodium sulfate, filtered, and evaporated under reduced pressure at 50°-60° C. using a vacuum pump for the final 15 min. to obtain 2.26 g of 3,6-dichloropicolinic acid as a white solid (8.60 g total yield).

The results of a number of runs made using an electrolytic cell with a Hastalloy C-276 anode and an expanded silver cathode in a similar manner are given in the following table:

| Reaction Time, Hrs. | Current Efficiency, Percent | 3,6-Dichloropicolinic Acid Yield, Percent | 3,6-Dichloropicolinic Acid Purity Percent |
|---|---|---|---|
| 2.30 | 77.1 | 99.0 | 99.6 |
| 2.60 | 74.2 | 97.6 | 98.2 |
| 2.10 | 74.3 | 95.5 | 98.2 |
| 2.05 | 75.4 | 94.7 | 98.6 |
| 2.00 | 71.0 | 93.3 | 98.9 |
| 2.00 | 73.8 | 98.3 | 99.8 |
| 2.00 | 74.2 | 95.3 | 97.1 |
| 1.80 | 74.7 | 94.6 | 97.3 |

EXAMPLE 2

An electrolysis cell having multiple expanded metal silver plate cathodes and Hastalloy C-276 plate anodes disposed alternatively and in a parallel array was operated in a continuous mode to reductively dechlorinate tetrachloropicolinic acid to 3,6-dichloropicolinic acid. The electrolysis was conducted at about 50° C. with a current density of below 0.10 amp/cm$^2$ and a Luggin voltage at the cathode of less than 1.3 V. The cathode was reactivated at frequent intervals by the usual methods. The electrolyte contained about 2 percent sodium hydroxide, less than 3.6 percent sodium chloride, and about 1.2 percent tetrachloropicolinic acid. During electrolysis, the concentrations of sodium hydroxide and tetrachloropicolinic acid were maintained by adding solutions containing 25% sodium hydroxide and 12% tetrachloropicolinic acid as needed. The cell effluent was acidified with hydrochloric acid to precipitate the 3,6-dichloropicolinic acid produced. High yields of 3,6-dichloropicolinic acid having high and relatively constant purity were obtained.

The cell was operated for 11 months with visual inspection of the electrodes every 3 to 4 months with no problems relating to the anodes. Very little corrosion of the anodes was observed.

What is claimed is:

1. A process for the selective replacement of chlorine in an organochlorine compound with hydrogen which comprises adding an organochlorine compound, water, and an electrolyte to an electrochemical cell, which cell comprises an anode having as its surface an alloy comprising essentially about 40 to about 70 percent nickel, about 5 to about 30 percent chromium, and about 3 to about 25 percent molybdenum, and passing a current through the cell.

2. A process according to claim 1 wherein the alloy comprises about 50 to about 65 percent nickel, about 12 to about 20 percent chromium, and about 4 to about 20 percent molybdenum.

3. A process according to claim 2 wherein the alloy comprises approximately 55 percent nickel, 16 percent chromium, 16 percent molybdenum, 5 percent iron, 4 percent tungsten, 2.5 percent cobalt, and 1 percent manganese.

4. A process according to claim 3 wherein the cell further comprises a cathode having a silver surface.

5. A process according to claim 4 wherein the silver has a layer of microcrystals formed by electrolytic reduction of colloidal, hydrous silver oxide particles in the presence of aqueous base.

6. A process according to claim 1 wherein the cell further comprises a cathode having a silver surface.

7. A process according to claim 6 wherein the silver has a layer of microcrystals formed by electrolytic reduction of colloidal, hydrous silver oxide particles in the presence of aqueous base.

8. A process according to claim 1 wherein the cell comprises multiple anodes and multiple cathodes.

9. A process according to claim 8 operating in a continuous manner.

10. A process for preparing 3,6-dichloropicolinic acid which comprises adding tetrachloropicolinic acid or 3,5,6-trichloropicolinic acid and an aqueous alkaline electrolyte to an electrochemical cell, which cell comprises an anode having as its surface an alloy comprising essentially about 40 to about 70 percent nickel, about 5 to about 30 percent chromium, and about 3 to about 25 percent molybdenum, and passing a current through the cell.

11. A process according to claim 10 wherein the alloy comprises about 50 to about 65 percent nickel, about 12 to about 20 percent chromium, and about 4 to about 20 percent molybdenum.

12. A process according to claim 11 wherein the cell further comprises a cathode having a silver surface.

13. A process according to claim 12 wherein the silver has a layer of microcrystals formed by electrolytic reduction of colloidal, hydrous silver oxide particles in the presence of aqueous base.

14. A process according to claim 11 wherein the alloy comprises approximately 55 percent nickel, 16 percent chromium, 16 percent molybdenum, 5 percent iron, 4 percent tungsten, 2.5 percent cobalt, and 1 percent manganese.

15. A process according to claim 10 wherein the cell further comprises a cathode having a silver surface.

16. A process according to claim 15 wherein the silver has a layer of microcrystals formed by electrolytic reduction of colloidal, hydrous silver oxide particles in the presence of aqueous base.

17. A process according to claim 10 wherein the cell comprises multiple anodes and multiple cathodes.

18. A process according to claim 17 operating in a continuous manner.

* * * * *